US006722039B2

(12) United States Patent
Kitano

(10) Patent No.: US 6,722,039 B2
(45) Date of Patent: Apr. 20, 2004

(54) MANUAL SAFETY STRAIGHT RAZOR HAVING DOUBLED-SIDED BLADES

(76) Inventor: Haruyuki Kitano, 2-17, Imaizumi 3-chome, Utsunomiya City, Tochigi Prefecture (JP)

( * ) Notice: Subject to any disclaimer, the term of this patent is extended or adjusted under 35 U.S.C. 154(b) by 0 days.

(21) Appl. No.: 10/251,807

(22) Filed: Sep. 23, 2002

(65) Prior Publication Data

US 2003/0196330 A1 Oct. 23, 2003

(30) Foreign Application Priority Data

Apr. 22, 2002 (JP) ..... 2002/118741

(51) Int. Cl.[7] ..... B26B 21/10; A45D 2/50

(52) U.S. Cl. ..... 30/50; 30/30; 30/53; 30/55; 30/57; 30/62; 30/81

(58) Field of Search ..... 30/53, 55, 50, 30/30, 62, 81, 77, 57

(56) References Cited

U.S. PATENT DOCUMENTS

| | | | | | |
|---|---|---|---|---|---|
| 1,108,839 | A | * | 8/1914 | Foley | 30/55 X |
| 1,280,972 | A | * | 10/1918 | Dignam | 30/30 |
| 1,332,587 | A | * | 3/1920 | Yeomans | 30/30 |
| 1,401,915 | A | * | 12/1921 | Mainwaring | 30/50 X |
| 2,530,918 | A | * | 11/1950 | Taylor | 30/30 |
| 3,165,831 | A | * | 1/1965 | Carroll | 30/53 X |
| 3,255,523 | A | * | 6/1966 | Robertson et al | 30/53 X |
| 3,456,340 | A | * | 7/1969 | Mondiello | 30/30 |
| 3,613,233 | A | * | 10/1971 | Lundell | 30/30 |
| 3,728,788 | A | * | 4/1973 | Pearson | 30/53 |
| 4,037,322 | A | * | 7/1977 | Bresler | 30/53 |
| 4,665,615 | A | * | 5/1987 | Martinez | 30/53 |
| 4,920,644 | A | * | 5/1990 | LaGattuta | 30/50 X |
| 4,955,136 | A | * | 9/1990 | Diaz-Rivera | 30/50 X |
| 5,649,364 | A | * | 7/1997 | Ilanlou | 30/50 X |
| 6,164,290 | A | * | 12/2000 | Andrews | 30/30 X |

FOREIGN PATENT DOCUMENTS

| | | |
|---|---|---|
| JP | 62-104770 | 7/1987 |
| JP | 6-11674 | 2/1994 |
| JP | 6-46673 | 6/1994 |
| JP | 6-277369 | 10/1994 |
| JP | 11-114246 | 4/1999 |

* cited by examiner

*Primary Examiner*—Charles Goodman
(74) *Attorney, Agent, or Firm*—Wenderoth, Lind & Ponack L.L.P.

(57) ABSTRACT

A manual straight razor includes an elongated front cutter portion having a rear end. The front cutter portion has an elongated wide opening which is slightly, downwardly narrowed. A complementary razor holding structure is snugly inserted in to the side opening and has a V-shaped lower member having a rounded end portion, along which a number of grooves are provided. When the razor holding structure attached to a pair of razor blades is snugly inserted into the wide opening, a pair of gaps is formed between the razor blades and the V-shaped lower-member. Soapsuds are passed through the grooves and kept temporarily in the gaps, and the soapsuds are rinsed away in flowing water or liquid medicine. A correct angle of inclination of a line linking the lowest point on each respective razor blade and the lowest point on the rounded elongated lower member can be easily adjusted to between 20 and 30 degrees to fit the razor blades on the face of the skin for safe shaving of hair.

10 Claims, 5 Drawing Sheets

FIG. I
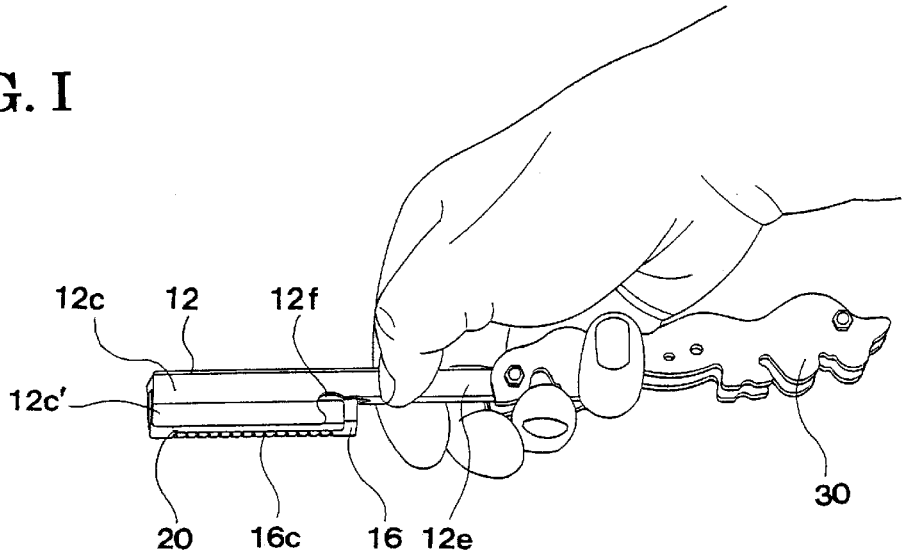
FIG. 2
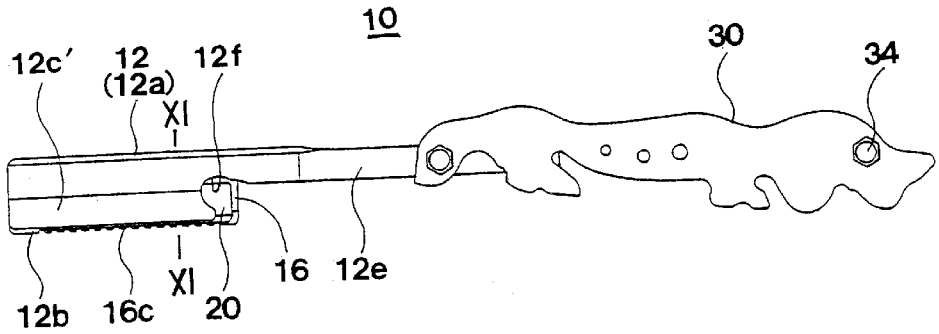
FIG. 3
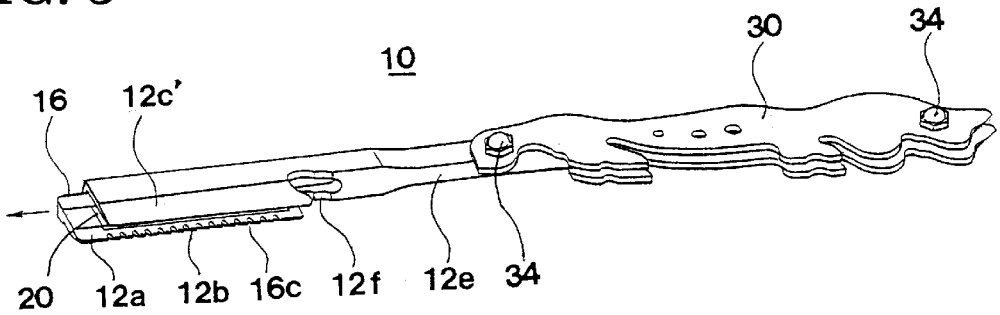

MANUAL SAFETY STRAIGHT RAZOR HAVING DOUBLED-SIDED BLADES

BACKGROUND OF THE INVENTION

1. Field of the Invention

This application is an improvement of the parent application of U.S. patent application Ser. No. 09/983,282 filed Oct. 23, 2001. This invention relates to a manual straight razor having double-sided razor blades, and more particularly to in-line double-sided straight razor blades having dual razor-sharp cutting edges positioned at front and rear guards which can easily be used both by professionals and at-home users either by pulling or pushing a razor blade strip for precise and safe shaving of hair from the face and other body regions.

2. Description of the Prior Art

There are different kinds of razors, such as professional use, home use or disposable razors on the market. Since a sharp blade of a razor is used in direct contact with the skin to remove hair from the skin, vigilant attention must be given to shaving.

In order to avoid a possible accidental cut, nick or scrape when using a straight razor, especially when in the hands of home users rather than a professional such as a barber or beautician, T-bar razors have been widely used and are still in use.

Since the advent of blood-transmitted communicable diseases such as AIDS, the HIV virus, hepatitis and other serious diseases, there is a serious social problem. Even a trained professional such as barbers or beauticians will from time to time accidentally cut, nick or scrape the skin of their customers with razors, causing some minor bleeding. Barbers, beauticians and healthcare workers are reluctant to come into contact with blood from others, and tend to avoid tasks where such contact is likely.

Under the above circumstances, sharpening a razor blade edge of a Western manual straight razor on a razor strop or a whetstone has been remarkably decreased, and special sterilization by a public health center has recently been made obligatory for professional razors used in barbershops or beauty parlors. In barbershops or beauty parlors, the used razors are usually disinfected in a sterilization chamber or sterilized in a disinfectant including invert soap, disinfecting ethanol etc.

In order to avoid an accidental cut, nick or scrape of the skin, vigilant attention from the skilled barber or beautician is not sufficient, and so a safety razor with which such accidental cuts are not possible is required. Furthermore, it is usual for a barber or beautician to shave a face with a razor which is pulled or pushed into a fan-like or arch-like direction by a wrist motion.

This inventor has proposed the manual straight razor having double-sided razor blades (Japanese Patent Application No. 234215/2001). An elongated wide opening is formed longitudinally in an upper part of the elongated front handle portion. The insides of an elongated rectangular wide opening and the corresponding insides of a complementary razor holding structure are parallel with each other so that a pair of razor blades is likely off the elongated rectangular wide opening of the holder.

Conventionally fixed at the holder is the razor blade, only the front edge of which is used. When the front portion of the blade has lost its edge, the razor blade itself is scraped and has to be exchanged with a new one. In addition, when the straight edge of a razor blade is laid down, a long or short mustache cannot be shaved efficiently. Furthermore, the soapsuds containing shaved hair and mustache, scratches and sebaceous matter are clogged into the gaps between the sides of the elongated rectangular wide opening and the sides of the complementary razor holding structure, thus causing the razor blade to lose its edge.

The double-sided straight razor of this invention is based on the applicant's long experience as a barber, from which he has realized that an angle inclination (relative to the skin surface) of the line linking the lowest point of a rounded end of a support for the blade, which is to contact the skin, must have an angle between 20 and 30 degrees when the razor blade is held perpendicular to the skin.

It should be understood that if the angle of inclination of the line linking the lowest point on a blade edge of a razor and the point of the support which is to contact the skin is less than 20 degrees relative to the skin surface when the blade is held perpendicular thereto, a shaving angle of the blade edge in use is too low so that it scrapes the skin, thus causing insufficient shaving of facial hair. If, however, the inclination angle is over 30 degrees, the blade edge presents a sharp edge and can cut the skin accidentally.

(1) U.S. Pat. No. 6,164,290 issued to Edward A. Andrews discloses a double-sided straight razor blade having dual razor-sharp cutting edges positioned at front and rear guards, and an in-line handle, which can easily be gripped for precise shaving of the face and other body regions. This double-sided straight razor has four razor strips, which cannot be used both for pull and push shavings.

(2) The Japanese Patent Publication No. 114246/1999 (not examined) discloses a change blade-type razor and a method of shaving the face and other body regions, with which a safe and slant shaving can be easily carried out even by an unskilled user.

(3) The Japanese Patent Publication No. 277369/1994 (not examined) shows a wet-type razor device 1 which comprises a long handle portion, and a shaving portion mounted to the long handle portion by fixing parts for shaving hair from the face and other body regions.

(4) The Japanese Utility Model Publication No. 11674/1994 (not examined) discloses a safety razor having double-sided straight razor blades, which comprises a handle portion, an elongated cutter portion, and a pair of razor blades provided at both sides of a back portion of the front cutter portion. A plane linking the belly of the front cutter portion extending to the back portion including a pair of razor blade strips and a plane linking the razor blade strips and the back portions are substantially parallel to eachother.

(5) The razor shown in the Japanese Utility Model Publication No. 104770/1987 (not examined) has a handle portion, a pair of connecting portions, a pair of support portions, a pair of blade strips held into the support portions, and a sponge inserted between the blade strips and the support portions.

(6) The razor holder described in the Japanese Utility Model Publication No. 104770/1987 (not examined) includes a handle portion having a holder, which comprises a groove so that a razor blade strip can be easily made.

SUMMARY OF THE INVENTION

A principal object of this invention is to provide a manual safety straight razor having double-sided blades that can easily be gripped both by professionals and home users for easy, precise and safe shaving of hair from the face and other body regions.

Another object of this invention is to provide a manual safety straight razor having double-sided razor blades with which an accidental cut, nick or scrape of the skin can be avoided to prevent infection of blood-infected communicable diseases such as AIDS, the HIV virus, hepatitis and other serious diseases.

Another object of this invention is to provide a manual safety straight razor having double-sided razor blades, in which the angle of inclination of a line linking the lowest point on each respective razor blade and the lowest point on a rounded elongated lower member portion is between 20 and 30 degrees with respect to the skin surface in order to fit the razor blades on the face of the skin with a shallow angle of inclination for shaving.

Another object of this invention is to provide a manual safety straight razor having double-sided blades, in which both of the angles of inclination of lines linking each razor blade and a rounded elongated lower member portion of a complementary razor holding structure is between 20 and 30 degrees with respect to the skin in order to enable a user either to pull or push the razor blades on the surface of the skin.

Another object of this invention is to provide a manual safety straight razor having double-sided blades, in which a number of parallel, arched or slanting grooves are provided along a rounded V-shaped lower member of a complementary razor holding structure so that the soapsuds containing shaved hair and mustache, scratches and sebaceous matter are introduced through these grooves and kept temporarily in the gaps between a pair of two razor blades and the V-shaped lower member in order not to lose the edge of the razor blade.

Another object of this invention is to provide a manual safety straight razor having double-sided blades, in which the soapsuds containing shaved hair and mustache, scratches and sebaceous matter which are temporarily kept in the gaps between a pair of two razor blades and the V-shaped lower member can be easily rinsed away in flowing water or liquid medicine in order not to lose the edge of the razor blade.

Another object of this invention is to provide a manual safety straight razor having double-sided blades, in which the soapsuds containing shaved hair and mustache, scratches and sebaceous matter are not clogged around a pair of razor blades and the V-shaped lower member in order not to lose the edge of the razor blade.

Another object of this invention is to provide a manual safety straight razor having double-sided blades, in which a pair of razor blades is not off the elongated rectangular wide opening of the holder.

Another object of this invention is to provide a manual safety straight razor having double-sided blades, in which front and rear portions of the razor blades can easily be turned around to draw a figure of in order to extend the life of the razor blade.

Another object of this invention is to provide a manual safety straight razor having double-sided blades, in which a front portion of each razor blade can easily be changed by arranging it in the opposite direction in order to extend the life of the razor blade.

Another object of this invention is to provide a manual safety straight razor having double-sided blades which can easily be used both by professionals and home users either by pulling or pushing the razor for easy, precise and safe shaving of hair from the face and other body regions.

Another object of this invention is to provide a manual safety straight razor having double-sided blades which can easily be pulled or pushed by a wrist motion of a user.

Another object of this invention is to provide a manual safety straight razor having a fingertip dent a neck portion of an elongated front cutter portion, in which a complementary razor holding structure attached to a pair of razor blades on both sides of the structure can easily be slid into or pulled out of an elongated wide opening of the elongated front cutter portion.

Another object of this invention is to provide a manual safety straight razor having double-sided blades, in which a correct angle of inclination of a pair of razor blades can easily be applied to a face or other body regions.

Another object of this invention is to provide a manual safety straight razor having double-sided blades, which is simple in construction, so that it can be easily made.

Still another object of this invention is to provide a manual safety straight razor having double-sided blades whereby many individuals prefer to use the professional services of a barber or beautician of a facial shaving without anxiety.

BRIEF DESCRIPTION OF THE DRAWINGS

The objects and features of the invention will become apparent from the following description taken in conjunction with the preferred embodiment thereof with reference to the accompanying drawings, in which:

FIG. 1 is a perspective view schematically showing a manual safety straight razor having double-sided blades according to this invention, which is being held by a hand for shaving;

FIG. 2 is a front view of the manual safety straight razor shown in FIG. 1;

FIG. 3 is a perspective view of the manual safety straight razor shown in FIG. 2, showing that a complementary razor holding structure mounted with a pair of razor blades is being pulled out in a front direction;

DETAILED DESCRIPTION OF THE PREFERRED EMBODIMENT

Figure 4:
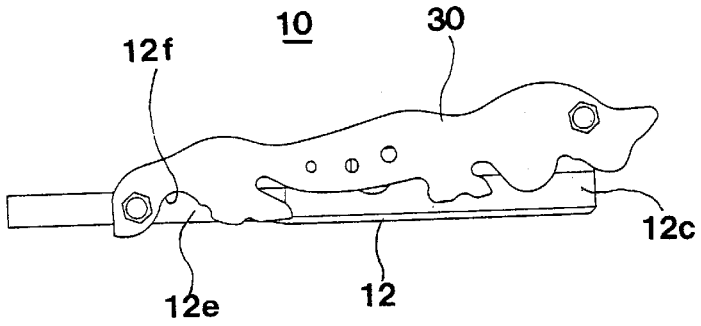
FIG. 4 is a perspective view of the manual safety straight razor showing that an elongated front cutter handle portion is folded into a rear handle portion.

Referring now to the accompanying drawings in which like numerals designate like parts throughout the figures, FIGS. 1~4 show a manual safety straight razor 10 having double-sided blades including an elongated front cutter portion 12 and an elongated rear handle portion 30 which is pivotally and rotationally secured to a rear portion of the elongated front cutter portion 12.

The elongated rear handle portion 30 has a pair of dog-deformed plates 30*a*, 30*a* which are joined together by a bolt 32, nut 34, washers 36 and a ring 38.

Figure 5:
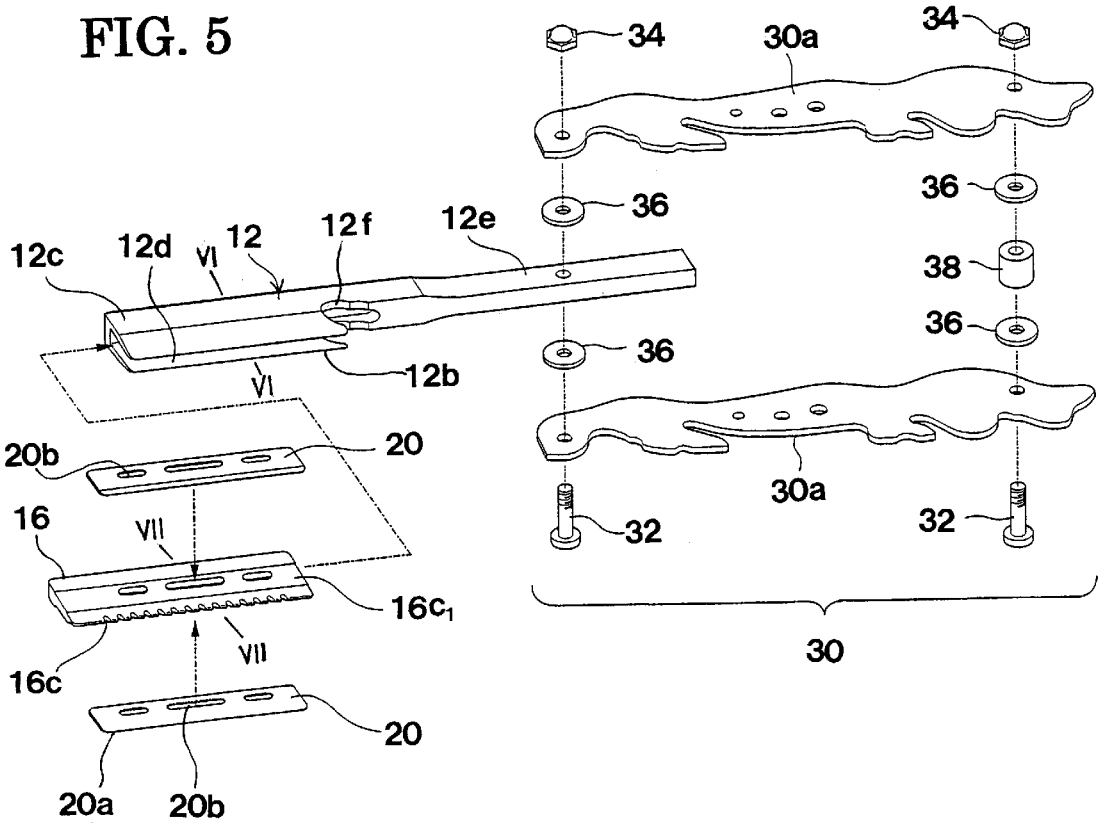
FIG. 5 is an exploded perspective view showing the arrangement of the parts of the manual safety straight razor shown in FIGS. 1~4.
Figure 6:
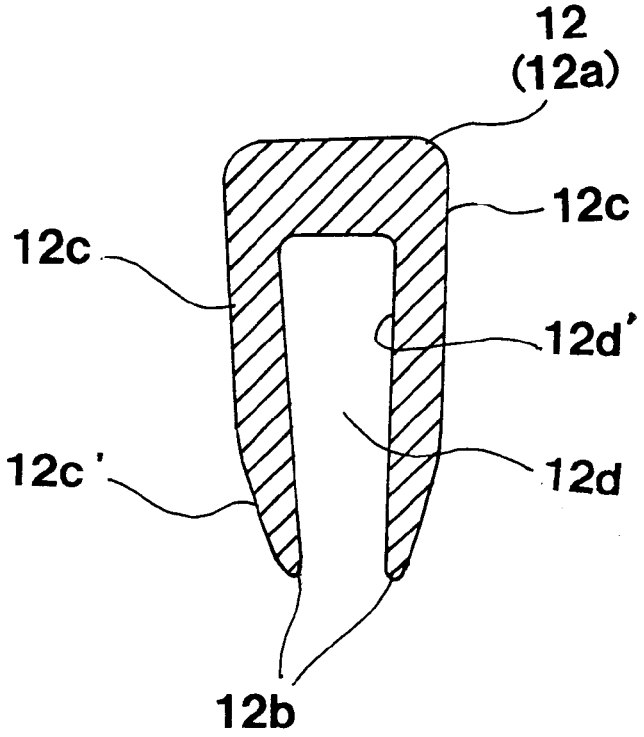
FIG. 6 is a partially enlarged sectional view of a front portion of a double-sided cartridge, taken along line V1—V1, of the manual safety straight razor shown in FIGS. 5.

As shown in FIG. 5 and 6, the elongated front cutter portion 12 has a longitudinal cutter head portion 12*a*, an elongated wide opening 12*d* for holding a complementary razor holding structure 16, a pair of first exposed (i.e., outer side) surfaces 12*c*, 12*c* extending from head portion 12*a* so as to be slightly, downwardly narrowed (i.e., angled toward each other), and a pair of second exposed surfaces 12*c*', 12*c*' which are further narrowed and curved to form a pair of narrow wedge portions 12*b*, 12*b* which are spaced from each other to form the opening 12*d*.

Figure 7:
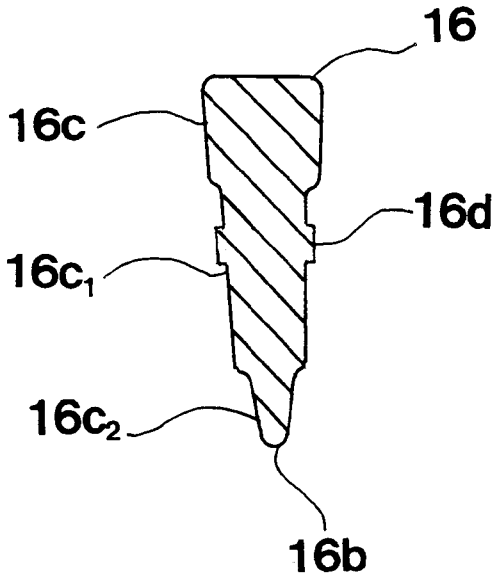
FIG. 7 is a partially enlarged sectional view of a complementary razor holding structure, taken along line V11—V11, of a manual safety straight razor shown in FIGS. 5.

FIG. 7 is a partially enlarged sectional view of a complementary razor holding element 16 which includes a pair of first slightly, downwardly narrowed side surfaces 16*c*, 16*c* (i.e., surfaces angled toward each other) corresponding to the inner faces of the elongated wide opening 12*d*, a pair of longitudinal grooves (recessed portions) $16c_1$, $16c_1$, a plurality of projections 16*d*, 16*d* provided longitudinally with a given interval, and a V-shaped lower lip portion $16c_2$ (having a rounded end portion 16*b*), and the side surfaces 16*c* are brought into contact with the inner faces 12*d*', 12*d*' of the elongated wide opening 12*d*.

The complementary razor holding element 16 attached to the razor blades 20, 20 on either side is snugly inserted into the elongated wide opening 12*d* so that a pair of gaps 22, 22 are formed between the razor blades 20, 20 and the V-shaped lower member 16*c*.

As shown in FIG. 5 and FIGS. 11–13, the projections 16*d*, 16*d* of the complementary razor holding element 16 are inserted into slits 20*b* of the razor blades 20 for interlocking the razor blades 20.

Figure 8:
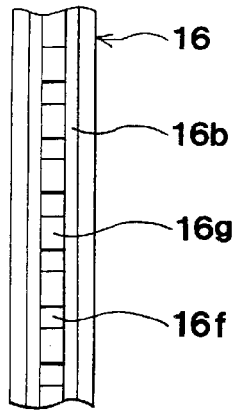
FIG. 8 is a partially enlarged front view of a complementary razor holding structure showing a number of parallel grooves provided along a rounded elongated lower member portion of the complementary razor holding structure.

As shown in FIG. 8, a manual safety straight razor 10 has a number of parallel grooves 16*f*, 16*f* which are spaced apart longitudinally with a given interval 16*g* along the V-shaped lower lip portion $16c_2$, whereby the soapsuds containing shaved hair and mustache, scratches and sebaceous matter are passed through the parallel grooves 16*f*, 16*f* and kept temporarily in the gaps 22, 22 between the sides of the elongated rectangular wide opening 12*d* and the sides of the complementary razor holding element 16.

Figure 9:
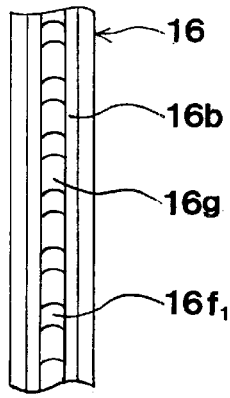
FIG. 9 is a partially enlarged front view of a complementary razor holding structure showing a number of arched grooves provided along a rounded elongated lower member portion.

In FIG. 9, a manual safety straight razor 10 has a number of arched grooves $16f_1$, $16f_1$, which are spaced apart longitudinally at a given interval 16*g* along the V-shaped lower lip portion $16c_2$, whereby the soapsuds containing shaved hair and mustache, scratches and sebaceous matter are passed through the arched grooves $16f_1$, $16f_1$ and kept temporarily in the gaps 22, 22 between the sides of the elongated rectangular wide opening 12*d* and the sides of the complementary razor holding element 16.

Figure 10:
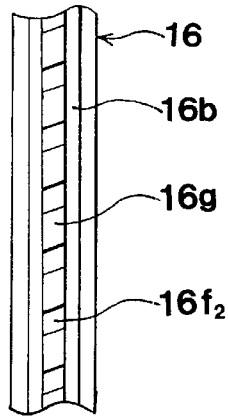
FIG. 10 is a partially enlarged front view of a complementary razor holding structure showing a number of slanted grooves provided along a rounded elongated lower member portion.

As shown in FIG. 10, a manual safety straight razor 10 has a number of slanted grooves $16f_2$, $16f_2$ which are spaced apart longitudinally at a given interval 16*g* along the V-shaped lower lip portion $16c_2$, whereby the soapsuds containing shaved hair and mustache, scratches and sebaceous matter are passed through the slanted grooves $16f_2$, $16f_2$ and kept temporarily in the gaps 22, 22 between the sides of the elongated rectangular wide opening 12*d* and the sides of the complementary razor holding element 16.

Figure 11:
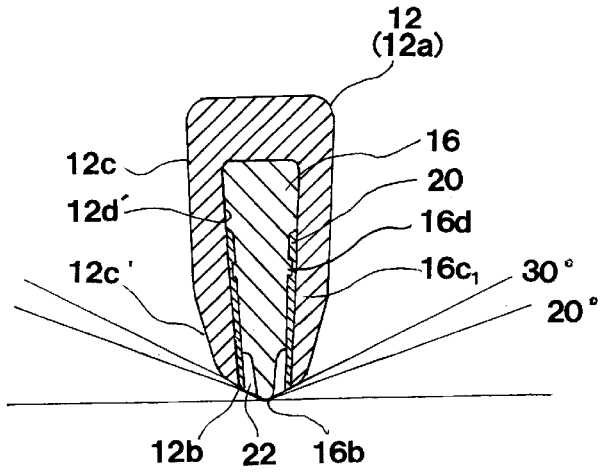
FIG. 11 is a partially enlarged sectional view, taken along line X1—X1 of a longitudinal cutter head portion and a complementary razor holding structure which are vertically positioned on the skin surface.
Figure 12:
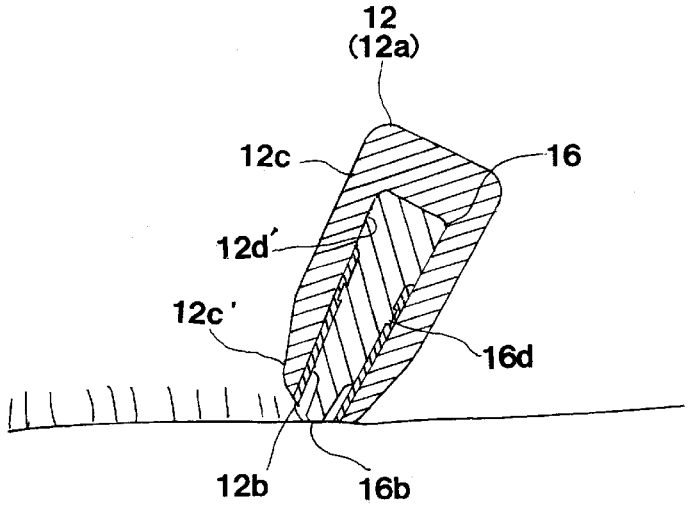
FIG. 12 is an enlarged schematic longitudinal sectional view of the manual safety razor which is vertically fitted on the skin surface.
Figure 13:
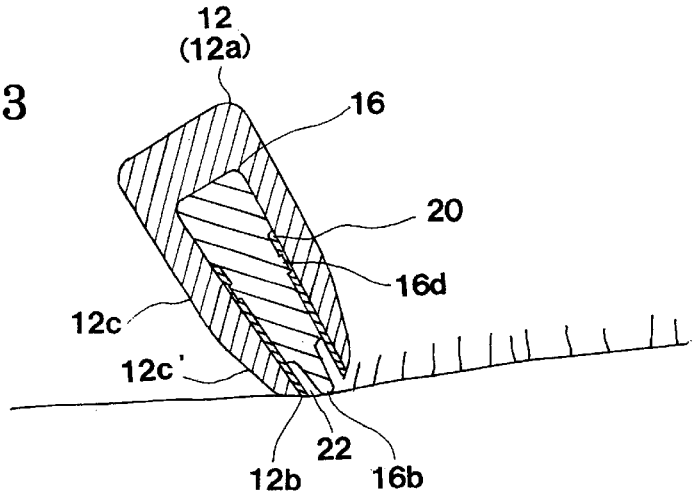
FIG. 13 is an enlarged schematic longitudinal sectional view of the manual safety razor which is fitted on the skin surface at a given angle for shaving hair.

In FIGS. 5 and 11, a pair of razor blades 20, 20, each blade having a plurality of slits 20*b* corresponding to the projections 16*d*, 16*d*, are detachably mounted on both of the recessed portions 16*c*, 16*c*, of the complementary razor holding element 16. Specifically, the projections 16*d*, 16*d* are inserted into the slits 20*b*, 20*b*, respectively, and a surface of each razor blade 20 is pressed against one of the recessed portions 16*c* of the razor holding element 16.

Accordingly, when the complementary razor holding element 16 is mounted into the elongated wide opening 12*d*, an imaginary V-shaped working surface is formed by a pair of an imaginary lines (at between 20 degrees and 30 degrees to the skin surface) linking the lowest point on the rounded end 16*b* and the lowest point (i.e., edge) of the razor blade 20 when the manual safety razor 10 is not inclined (i.e. when the manual safety razor 10 is held so that the elongated lower portion 16*c* is perpendicular to the skin surface as illustrated in FIG. 11).

It should be appreciated that the angle between the lowest point on the rounded end 16*b* and the lowest point of the razor blade 20 will always be between 20 and 30 degrees when the manual safety razor 10 is not inclined (i.e., perpendicular).

As mentioned in the foregoing paragraphs, a front portion of the edge of the razor blade 20 is easily lost (i.e., worn) so that it is preferable to swap the front portion with the rear portion of the razor blade 20 just like to drawing a figure of ∞ (i.e., flip the blade), thus extending the life of the razor blade. At the same time, a front portion of the razor blade 20 can easily be changed by arranging it in the opposite direction in order to extend the life of the razor blade.

The most important feature of this invention is that the manual safety straight razor has double-sided blades, and a number of parallel, arched or slanting grooves 16*f*, $16f_1$ or $16f_2$ are provided along the rounded V-shaped lower lip portion $16c_2$, of the complementary razor holding element 16 so that the soapsuds containing shaved hair and mustache, scratches and sebaceous matter are passed through these grooves 16*f*, $16f_1$ or $16f_2$ and kept temporarily in the gaps 22, 22. It is very easy for the user to rinse away the soapsuds containing shaved hair and mustache, scratches and sebaceous matter which are kept temporarily in these gaps 22, 22 by flowing water or liquid medicine. Accordingly, it is not necessary to suspend shaving hair of a customer for sharpening on a strop or whetstone when an edge of a razor blade has been lost by the clogged soapsuds on or around the edge of the razor blade.

It is also to be appreciated that the longitudinal cutter head portion 12*a* of the elongated head portion 12 has an elongated wide opening 12*d* which is slightly, downwardly narrowed, and the complementary razor holding element 16 having a pair of the razor blades 20, 20 is snugly slid into the elongated wide opening 12*d* so that the razor blades 20, 20 are not disengaged (dislodged).

As described in FIGS. 1–5, the manual safety straight razor 10 has a fingertip dent 12*f* at a neck portion of an elongated front cutter portion 12 so that the complementary razor holding element 16 attached to the pair of razor blades 20, 20 on both sides of the element 16 can easily be slid into or pulled out of the elongated wide opening 12*d* of the elongated front cutter portion 12.

In practice, the user places the elongated lower lip portion 16$c_2$ of the manual safety razor 10 on to the skin so that the razor blades 20, 20 extends vertically (i.e. perpendicular to the skin as shown in FIG. 11), and subsequently the manual safety razor 10 is inclined onto the surface of the skin.

In view of the fact that the angle of inclination of lines linking the razor blade edge 20*a*, 20*a* of the razor blades 20, 20 and the rounded end 16*b* is always between 20 and 30 degrees with respect to the skin surface when the manual safety razor 10 is not inclined, the razor blades 20, 20 are fitted softly at a suitable angle to the surface of the skin so that easy, safe and reliable shaving of hair from the surface of the skin can be carried out not only by a barber or beautician, but also by an unskilled user.

At the same time, both pulling and pushing motions of the inclined outer face of the razor blade edges 20*a*, 20*a* can be carried out easily and freely by the wrist motion of a user.

It is to be understood that the in-line safety straight razor of this invention is by no means limited to the particular embodiment and uses herein described, disclosed and/or shown in the drawings.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A manual safety straight razor comprising:

an elongated cutter portion having a head portion and a pair of wedge portions extending from said head portion and spaced apart to form an elongated opening therebetween;

a rear handle pivotally connected to a rear end of said cutter portion, said rear handle including a pair of joined plates;

a razor-holding element having side surfaces shaped to correspond to a shape of an inner surface of said wedge portions, each of said side surfaces having an elongated recessed portion and a projection extending from said recessed portion, said razor-holding element further having a V-shaped lip portion with a rounded end, said V-shaped lip portion having a plurality of parallel grooves each extending across said rounded end of said V-shaped lip portion, and said grooves being spaced apart along a longitudinal axis of said V-shaped lip portion; and a pair of double-sided razor blades attached to said side surfaces of said razor-holding element, each of said razor blades having a slit formed therein for receiving said projection of one of said side surfaces of said razor-holding element;

wherein said cutter portion, said razor-holding element, and said razor blades are arranged such that said razor-holding element having said razor blades attached thereto is inserted into said elongated opening of said cutter portion so that a gap is formed between each of said razor blades and said V-shaped lip portion, and so that a first imaginary line connecting said rounded end of said V-shaped lip portion and an edge of a first one of said razor blades and a second imaginary line connecting said rounded end of said V-shaped lip portion and an edge of a second one of said razor blades intersect to form an imaginary V-shaped working surface.

2. The manual safety straight razor of claim 1, wherein said razor blades are symmetrically arranged with respect to said V-shaped lip portion, and said cutter portion, said razor-holding element, and said razor blades are arranged such that each of said first imaginary line and said second imaginary line form an angle in a range of 20° to 30° with respect to a skin surface when said manual safety straight razor is held perpendicular to the skin surface.

3. The manual safety straight razor of claim 1, wherein said grooves are evenly spaced apart and are each orthogonal to the longitudinal axis of said V-shaped lip portion.

4. The manual safety straight razor of claim 1, wherein said grooves comprise evenly spaced apart arched grooves each extending across said rounded end of said V-shaped lip portion.

5. The manual safety straight razor of claim 1, wherein said grooves comprise evenly spaced apart grooves each extending across said rounded end of said V-shaped lip portion so as to be slanted with respect to the longitudinal axis of said V-shaped lip portion.

6. The manual safety straight razor of claim 1, wherein said plates of said rear handle are joined together by a bolt, nut, washers, and a spacer ring.

7. The manual safety straight razor of claim 1, wherein said wedge portions of said cutter portion have upper outer surface portions inclined toward each other, and have lower outer surface portions extending from said upper outer surface portions and inclined toward each other at an incline angle greater than an incline angle of said upper outer surface portions.

8. The manual safety straight razor of claim 1, wherein said side surfaces of said razor-holding element are inclined toward each other.

9. The manual safety straight razor of claim 1, wherein each of said side surfaces of said razor-holding element has a plurality of projections extending from said recessed portion, each of said razor blades having a plurality of slits for receiving said projections.

10. The manual safety straight razor of claim 1, wherein each of said razor-blades is arranged in said recessed portion of one of said side surfaces of said razor-holding element, said razor-holding element being inserted in said elongated opening of said cutter portion so that each of said razor blades is located between one of said wedge portions and said razor-holding element.

* * * * *